United States Patent [19]

Balderson

[11] Patent Number: 4,969,134

[45] Date of Patent: Nov. 6, 1990

[54] ELECTRO-OPTICAL SIGNALING SYSTEM

[76] Inventor: R. Bruce Balderson, 756 Sandy Ridge Rd., Doylestown, Pa. 18901

[21] Appl. No.: 261,675

[22] Filed: Oct. 24, 1988

[51] Int. Cl.[5] ..... G04C 17/00

[52] U.S. Cl. ..... 368/239; 368/223; 368/82

[58] Field of Search ..... 368/239–240, 368/82

[56] References Cited

U.S. PATENT DOCUMENTS

| | | | |
|---|---|---|---|
| 2,169,208 | 8/1939 | Adams | 368/240 |
| 3,596,462 | 8/1971 | Hayes | 368/82 |
| 3,841,082 | 10/1974 | Cuevas et al. | 368/82 |
| 3,958,409 | 5/1976 | Manber | 368/240 |
| 3,982,387 | 9/1976 | Tanaka | 368/82 |
| 4,007,583 | 2/1977 | Johnson | 368/240 |
| 4,041,692 | 8/1977 | Marshino | 368/240 |
| 4,068,465 | 1/1978 | Bacon | 368/239 |
| 4,370,068 | 1/1983 | Han | 368/240 |

*Primary Examiner*—Bernard Roskoski

*Attorney, Agent, or Firm*—Armand M. Vozzo, Jr.

[57] ABSTRACT

An electro-optical signaling system and associated method is disclosed for communicating numerical information, such as time of day or ambient temperature, to an observer. The signaling system comprises a linear array of flashing lights, established in a vertical direction, each light being connected in parallel to the output of a microprocessor for controlling the energization of the lights and the sequence thereof. With individual lights being normally "off" and under the control of the microprocessor, energization signals are delivered to the light array in accordance with a control algorithm to turn selected lights "on" and then "off" in a predetermined, serial sequence so that the array as a whole may display a coded message indicative of numerical digits.

6 Claims, 5 Drawing Sheets

ELECTRO-OPTICAL SIGNALING SYSTEM

BACKGROUND OF THE INVENTION

The present invention relates to lighting displays and more particularly to an improved electro-optical system and associated method for communicating numerical messages using a coded sequence of flashing lights.

In the field of visual display systems, lighting arrangements have traditionally been used to present a variety of alphanumeric messages to an observer. Typically by means of the controlled energization of selected lights in a matrix, such arrangements have effectively communicated the message of interest by spelling out the individual alphanumeric components of the message for viewing over a period of time. In some situations, however, it has been more appropriate to employ a flashing light or series of flashing lights, rather than steady energization levels, to convey a message more brief but immediate, such as a warning or alert to an observer as to the presence of a particular hazard. While such flashing lights, switched "on" and "off" at a periodic rate or at random, have long been effectively used as a warning signal, no system of such flashing lights has heretofore been developed that can communicate a message of numerical information to an observer in all directions surrounding the flashing light system.

SUMMARY OF THE INVENTION

Accordingly, it is a general purpose and object of the present invention to provide an improved electro-optical signaling system and associated method of employing flashing lights to communicate a numerical message to an observer in all radial directions 360° surrounding the flashing lights.

Another object of the present invention is to provide an electro-optical signaling system having a sequence of flashing lights that may be easily viewed and readily understood by observers from a variety of angles and attitudes.

Still another object of the present invention is to provide a signaling system of flashing lights that communicates useful numerical information such as that relative to time of day and ambient temperature, in a readily interpretable manner.

A still further object of the present invention is to provide an improved electro-optical signaling system that is simple to construct yet reliable in performance, and that is easily adopted for stationing in various display environments.

Briefly, these and other objects of the present invention are accomplished by an electro-optical signaling system and associated method for communicating numerical information, such as time of day or ambient temperature, to an observer. The signaling system comprises a linear array of flashing lights, established in a vertical direction, each light being connected in parallel to the output of a microprocessor for controlling the energization of the lights and the sequence thereof. With individual lights being normally "off" and under the control of the microprocessor, energization signals are delivered to the light array in accordance with a control algorithm to turn selected lights "on" and then "off" in a predetermined, serial sequence so that the array as a whole may display a coded message indicative of numerical digits.

For a better understanding of these and other aspects of the present invention, reference may be made to the following detailed description taken in conjunction with the drawing in which reference numerals and letters designated like parts throughout the figure thereof.

DESCRIPTION OF THE PREFERRED EMBODIMENT

Figure 1:
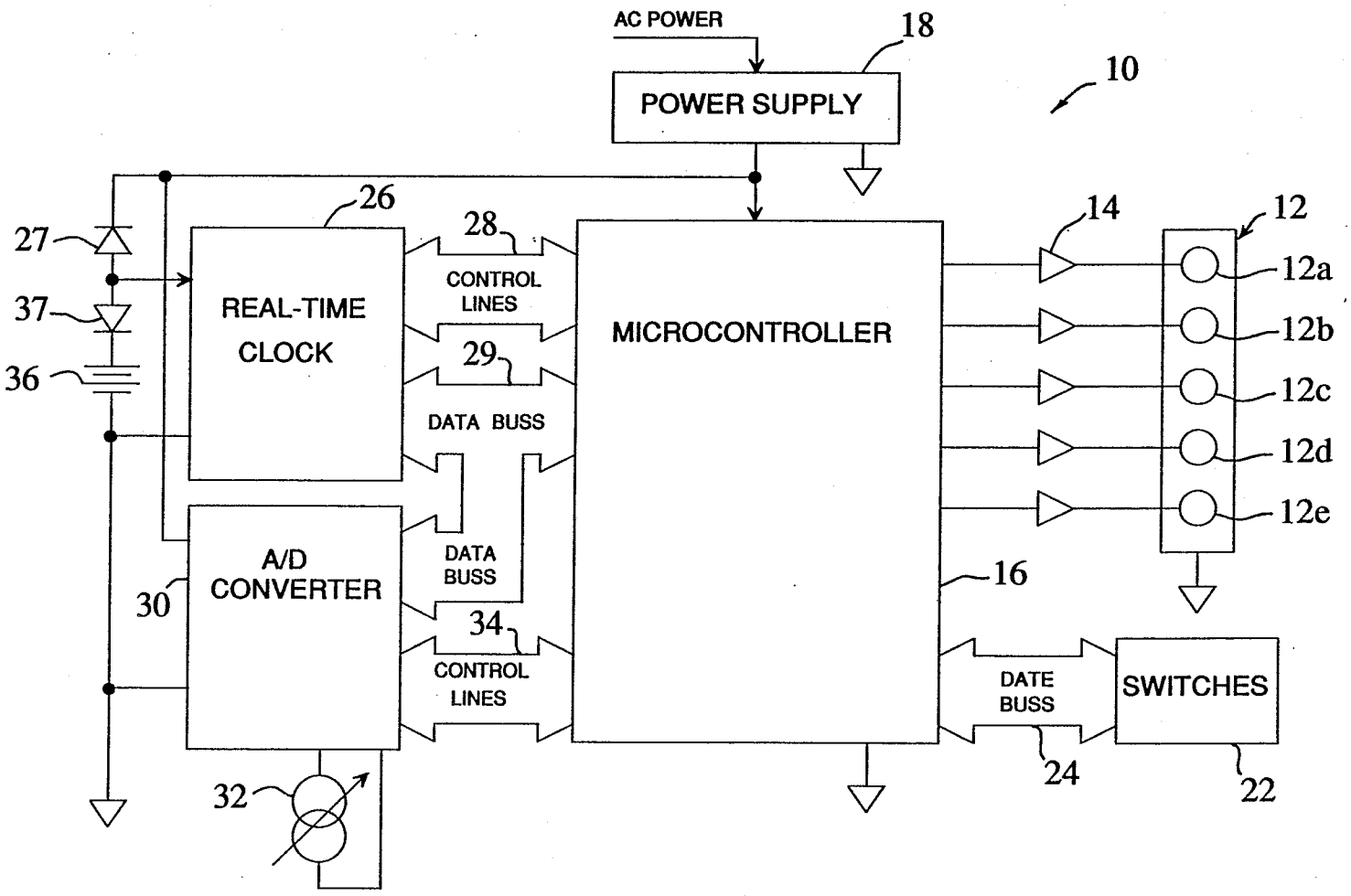
FIG. 1 is a block diagram of the electro-optical signaling system in accordance with the present invention.

Referring now to FIG. 1, there is shown an electro-optical signaling system 10 having, in accordance with the present invention, a light array 12 at the output thereof to provide a means for visual display of an intended numerical message. Light array 12 is comprised of a plurality of individual light elements 12*a*–12*e* arranged in a linear configuration, either vertically disposed, as shown, or in a horizontal direction. Each light element 12*a*–12*e* is connected separately and in parallel to the output of a programmed microcontroller 16 via respective buffers 14 so that the light elements may be energized selectively and sequentially in a coded pattern, as described in greater detail herein below.

The number of light elements 12*a*–12*e* should be at least three with five being preferred, as shown in FIG. 1. The light elements 12*a*–12*e* are typically clear although any suitably visible color, such as white or yellow, may be employed. In regard to the type of light elements 12*a*–12*e* that may be used in the light array 12 of the present electric-optical signaling system 10, miniature light-emitting devices (LEDs) are suitable provided an extended range for visibility of the array is not required. Larger light elements or lamps are also suitable for use in array 12 provided they have sufficiently rapid illumination rates to display a distinct level of light when turned from "off" to "on". Strobe lights, for example, are appropriate for use in the light array 12 of the present electro-optical signaling system 10.

Microcontroller 16 is a programmable microprocessor of digital design having a sufficient number of outputs to correspond with the number of light elements 12*a*–12*e* in light array 12. The microcontroller 16 preferred herein is a conventional device that is provided with operating power from a regulated DC power supply 18 of conventional design. A variety of commercially-available microprocessors may be used as microcontroller 16, one such microprocessor being a model HD 63701 VOP, manufactured by Hitachi.

The microcontroller 16 is connected to switches 22 via a data bus 24. The switches 22 are used to set the scan rate and digit delay between units (digits) displayed upon the electro-optical signaling system 10 as well as to set the time of the system clock. "Scan" is the term used to describe the ON/OFF period of each light element 12*a*–12*e* with respect to the next light. That is, the time that each individual light element 12*a*–12*e* is ON and OFF when a particular digit is being displayed. "Digit delay" is the term used to represent the time delay between the respective digits of the particular pattern being displayed or a complete scan of light array 12. As explained further in reference made to FIG. 2, such a light scan may be a single, simultaneous flashing of one or all elements 12*a*–12*e* of the array 12 or may be a sequential, unidirectional (downward or upward) flashing of the elements depending upon the intended numerical message.

The scan and digit delay are adjusted by switches 22 and are only set prior to AC power being applied to the electro-optical signaling system 10. Once the signaling system 10 is running, it is no longer possible to adjust the scan or delay time, as the switches 22 are then used for setting the time of the system clock. Regarding the clock setting of the electro-optical signaling system 10, it should be noted that the time may be changed whenever the signaling system is operating except when the light elements 12*a*–12*e* are in the process of outputting. Alternate means other than switches 22 can be used for inputting the scan rate, digit delay, and setting of the clock time. For example, an RS232 or similar interface receiving scan, digit delay and time inputs from a computer may be utilized in the present system 10. Switches 22 are preferred in the present system 10 for purposes of simplicity.

Microcontroller 16 is further connected to receive input data from a real-time clock module 26 via data buss 29. Clock module 26 is a conventional device capable of providing synchronous digital data, typically of a twelve-hour cycle, indicative of the time of day. A twenty-four hour cycle could also be offered. Microcontroller 16 and the real-time clock module 26 both operate in connection with a power supply 18 which is of conventional design operated from a standard AC power source for providing regulated low DC voltage, as required, to various parts of the electro-optical signaling system 10. Power supply 18, via diode 27, supplies DC power to the real-time clock 26. Battery 36, via diode 37, is connected to the real-time clock 26 and serves as a power source to the clock module 26 should AC power be interrupted or lost. Diodes 27 and 37 are blocking diodes used to block current flow depending whether the system 10 is being supplied power through the power supply 18 or battery 36.

Additional data inputs to microcontroller 16 are provided relevant to ambient temperature for display by the electro-optical signaling system 10. A thermal sensor 32 of conventional design for producing an analog signal indicative of ambient temperature is connected to an analog-to-digital (A/D) converter 30 for converting the analog temperature signal to a digital signal reflective of temperature. The temperature-related digital signal is then inputted to the microcontroller 16 in conjunction with the time-related data via data buss 29. The microcontroller 16 processes both sets of data for separate display upon light array 12. It is noted that alternate modules or sensing devices, other than clock module 26 and thermal sensor 32, may be employed in accordance with the present invention to provide numerical measurement data to microcontroller 16 for appropriate processing and display upon array 12 of the corresponding numerical message.

Figure 2:
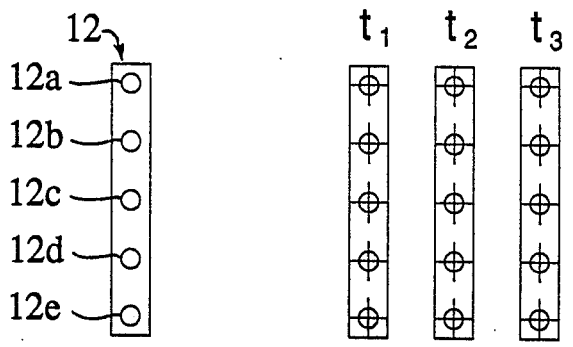
FIGS. 2(*a*)–(*c*) illustrate the sequential light pattern generated by the electro-optical signaling system of FIG. 1 to communicate numerical information in accordance with the present invention.
Figure 2:
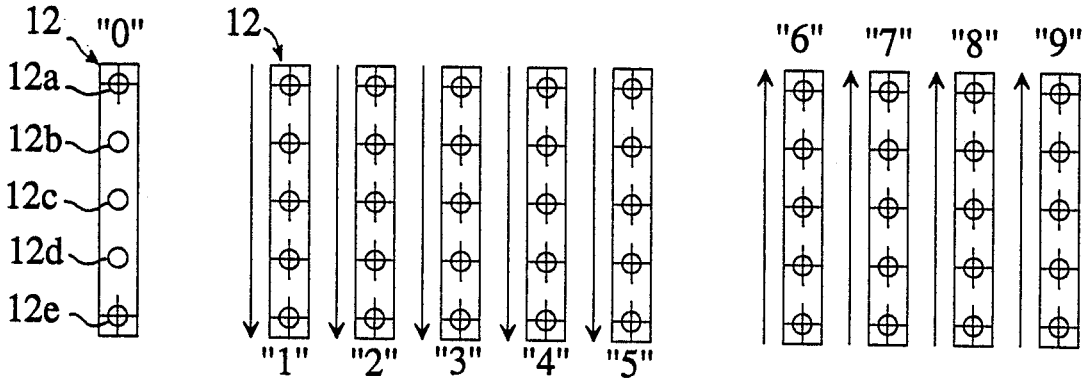
Figure 2:
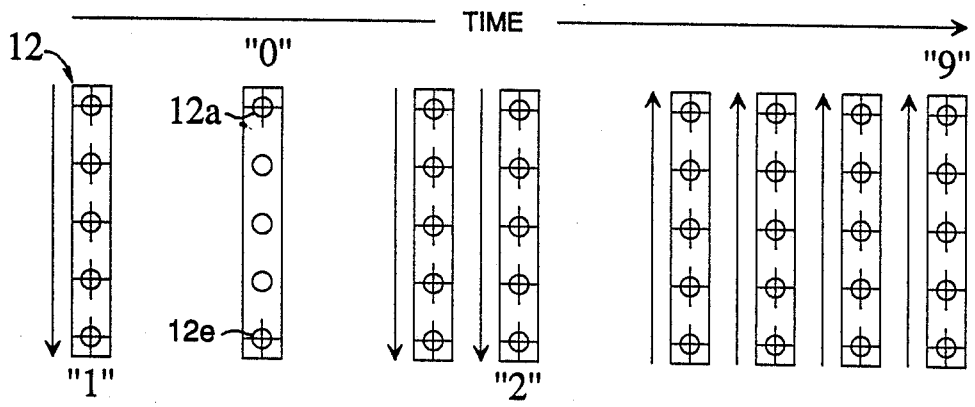

Referring now to FIGS. 2(*a*)–2(*c*) in conjunction with FIG. 1, microcontroller 16 is programmed in accordance with a control algorithm to provide light array 12 with energization signals that turn selected light elements 12*a*–12*e* "ON" and then "OFF" in a predetermined sequential pattern, the code for which translates into numerical information and is herein illustrated and explained. In referring to FIGS. 2(*a*)–2(*c*), it is intended that a clear, unmarked light element (0) 12*a*–12*e* is indicative of being "OFF", while the light elements bearing a cross pattern (⊕) is indicative of being "ON".

In accordance with the present invention, the coded light pattern intended to communicate a message of numerical information is essentially based upon the light sequence and the direction and repeated number of scans of the complete set of light elements 12*a*–12*e* in light array 12. The following explains the coded pattern and the numerical information displayed by the present electro-optical signaling system 10:

DIGIT "0"

The digit number "0" is always displayed by a single simultaneous flash of the respective top and bottom light elements 12*a* and 12*e*. The digit "0" is displayed with the top and bottom elements energized at the same time, as shown in FIG. 2(*b*), marked "0".

DIGITS "1", "2", "3", "4" and "5

The digit numbers "1", "2", "3", "4" and "5" are communicated by the number of scans in a dfownward direction of light elements 12*a*–12*e*. The number "1" would be a single (one) downward scan of light elements 12*a*–12*e* of array 12 and is indicative of the number "1". The digit number "2" would be a double (two) downward scans of light elements 12*a*–12*e* of array 12. Repeated downward scans to a maximum of five (5) communicates the digits "3", "4" and "5", respectively, as viewed in 2(*b*) and marked accordingly.

DIGITS "6", "7", "8" and "9"

The digit numbers "6", "7", "8" and "9" are communicated by the number of scans in an upward direction of the light elements 12*a*–12*e*. The number "6" would be a single (one) upward scan of light elements 12*a*–12*e* of array 12 and is indicative of the number "6". The digit number "7" would be a double (two) upward scan of light elements 12*a*–12*e* of array 12. Repeated upward scans of three and four in number then communicates the digit numbers "8" and "9", respectively. It is understood that groups of successive scans, with delays between numbers, may be indicative of not only single numbers but also tenths, hundredths, etc.

Accordingly, an example of the time display 10:29 of four (4) successive digits "1", "0", "2" and "9" is shown in FIG. 2(*c*) in the successive scans or patterns of the light elements 12*a*–12*e* of array 12 produced by the present electro-optical signaling system 10. One downward scan equals the number "1". After an appropriate digit delay, a simultaneous top and bottom light pattern equals the number "0". Following another digit delay, two downward scans equals the number "2". After a third digit delay, four upward scans equals the number "9". Hence the time display of 10:29 which the observer can construe as a.m. or p.m. depending on the portion of the day when observation is made. As a further example of a temperature display (not shown by figure), 73° F. would consist of two (2) successive digits "7" and "3", requiring five (5) scans in total. The digit "7" requires two upward scans with a delay and the digit "3" requires three downward scans of light elements 12*a*–12*e* of array 12.

To begin any numerical message, it is preferred that a simultaneous display of all light elements 12*a*–12*e* of light array 12 be initiated and repeated a predetermined number of times, such as three (3) times, as shown in FIG. 2(*a*) at points of time $t_1$, $t_2$, and $t_3$. This serves as a readily observable reference in preview of the intended numerical message and assures to the observer that all light elements **12*a*–12*e* of the array 12** are functioning.

Figure 3:
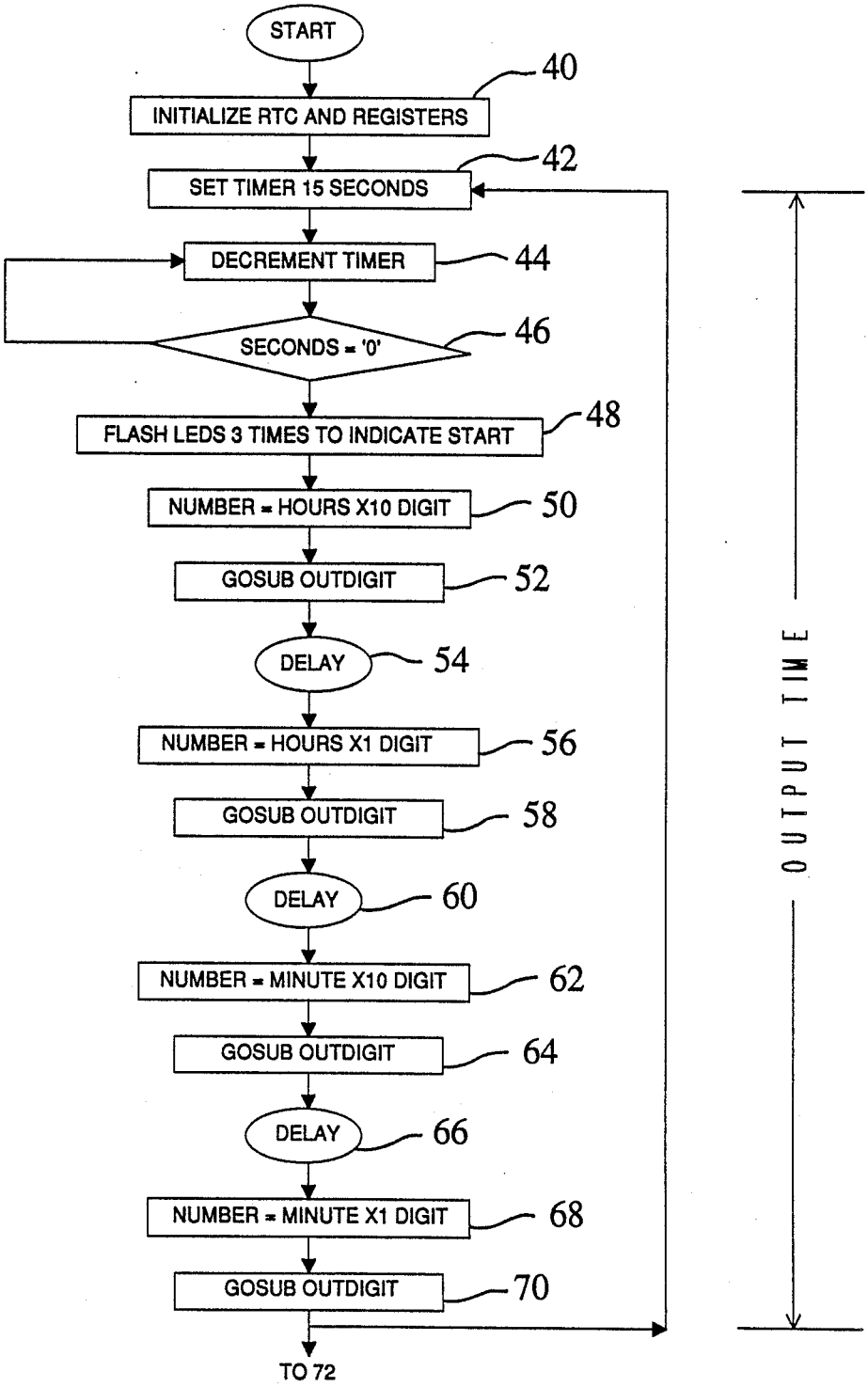
FIG. 3 is a flow chart which indicates the operating procedure of the control algorithm employed within the electro-optical signaling system of FIG. 1 to generate those light patterns of FIG. 2.
Figure 3:
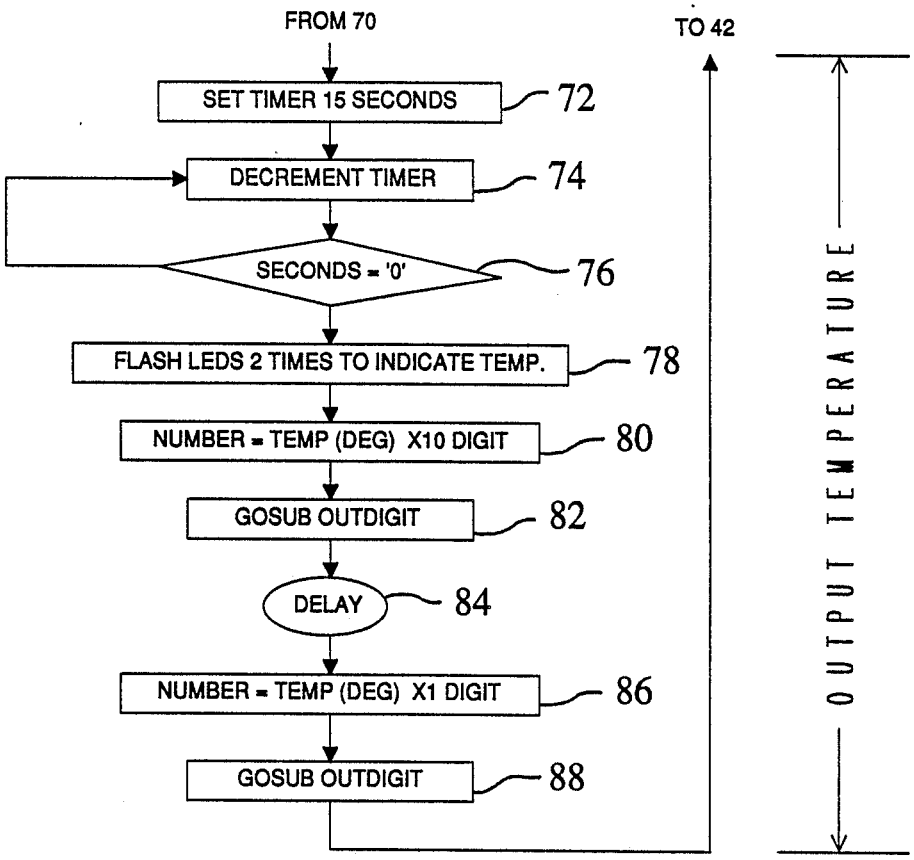
Figure 3:
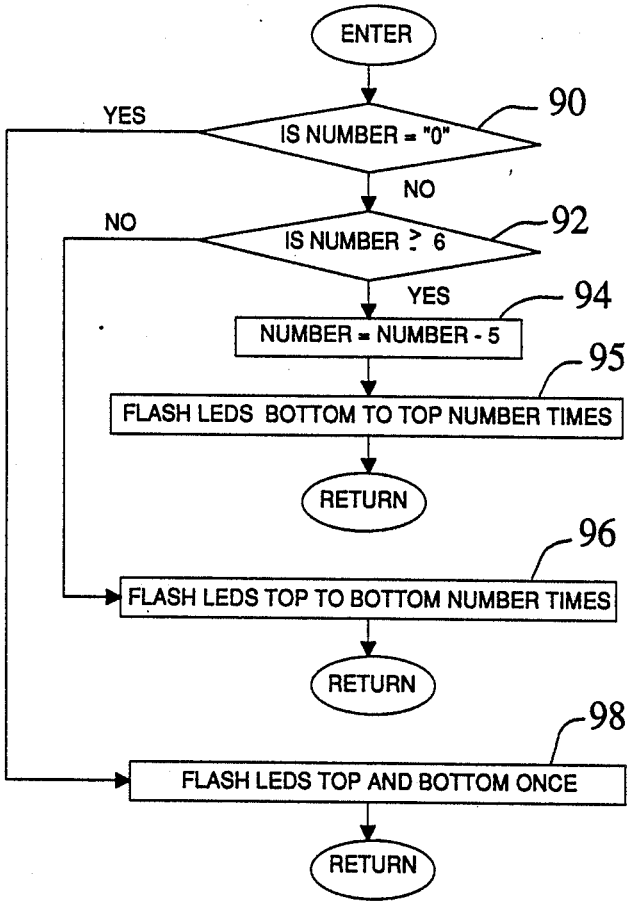

Referring now to FIG. 3, the control algorithm governing the function of microcontroller 16 and establishing the operation of the electro-optical signaling system 10 is illustrated by way of a flow diagram consisting of a main routine (Blocks 40–88, inclusive) and a subroutine (Blocks 90–98).

Starting in the main routine, when power is applied to the electro-optical signaling system 10, the first step in functioning of microcontroller 16 is to initialize its real-time clock 26 (RTC) and set its registers, as shown in Block 40. In Block 42, the display of present time by the signaling system 10 is programmed to be conducted over a predetermined period, preferably about fifteen seconds, by setting of an internal timer of microcontroller 16 for the predetermined period. In Block 44, a decrement timer also internal to microcontroller 16 subtracts one second from the present timer's contents of time. If the seconds equal "0", then all light elements **12*a*–12*e* of light array 12 are flashed three times, as shown in Block 48, to provide a reference indication to the observer that time display is about to begin. If the seconds are not equal to "0", then operation of microcontroller 16 moves back to Block 44** to decrement further time.

In Block 50, the microcontroller 16 initiates actual time display by getting the number of the hour ×10 digit (i.e. decimal value of the hour in "tens") from the real-time clock 26 before proceeding to the subrouting for appropriate signaling to the light array 12 of the corresponding hour digit. According to the subroutine, if the hour ×10 digit is equal to "0", appropriate signal is provided to flash top and bottom light elements **12*a* and 12*e*, respectively, as directed in Blocks 90 and 98. Thereafter, the microcontroller 16 is returned to the main routine for further hourly digit determination. If the hour ×10 digit is not equal to "0", then the subroutine requires a determination of the value of the hour×10 digit, and based upon that value, directs unidirectional flashing of light array 12 a certain number of times to indicate that value. Via Block 92, if the hour×10 digit is not greater than or equal to six, (presumably either a "1" or "2" in 24-hour time measurement) then the light elements 12*a*–12*e* are flashed from top to bottom (in the downward sequence) a repeated number of times equal to the number of the hour×10 digit. Accordingly, the light elements 12*a*–12*e* would be so downwardly flashed once for a "1", and twice for a "2". After the appropriate flashing sequence, downward as determined from the hour×10 digit, the microcontroller 16** is returned to the main routine for further instruction.

Back in the main routine and following the predetermined digit delay in Block 54, the microcontroller 16 obtains the number of the hour×1 digit (i.e. decimal value of the hour in "units") from the real-time clock 26 in Block 56. Proceeding to the subroutine via Block 58, a determination of the hour×1 digit as a "0" is first made in Block 90 and, if so, light elements **12*a* and 12*e* are flashed once simultaneously, as directed by Block 98, to indicate the "0" digit value. If not equal to "0", the value of the hour×1 digit is then determined relative to six at Block 92. If not greater then or equal to six, light array 12 is flashed from top to bottom (in downward sequence) a repeated number of times equal to the value of the hour×1 digit as directed by Block 96. Light elements 12*a*–12*e* would thus be downwardly scanned once for a "1", twice for a "2" and so on through "5". If the hour×1 digit is six or greater the subroutine proceeds via Block 94 to reduce the value by five and then direct the upward flashing (bottom to top) of light array 12, via Block 95, a repeated number of times based upon the reduced value. Accordingly, the light array 12 would be upwardly scanned once for a "6", twice for a "7" and so on through "9". Upon completion of that flashing of the light elements 12*a*–12*e* to display the hour×1 digit, the microcontroller 16** is again returned to the main routine for numerical determination of the minute digits of the time being displayed.

Following respective digit displays in Blocks 60 and 66, the microcontroller 16 then obtains the numbers of the minute digits, first the minute×10 digit (decimal value of the minute in "tens") in Block 62 and then the minute×1 digit (decimal value of minute in "units") in Block 68, and proceeds through the subroutine for each minute digit in the same manner as previously done for the hourly digits so that a distinct flashing pattern of the light elements **12*a*–12*e* is generated for each corresponding minute digit. A complete time display is thus provided by the electrooptical signaling system 10 consisting of four distinct flashing patterns of light array 12**.

For further clarification of the control algorithm, and particularly the operation of the subroutine in generating the associated flashing pattern upon light array 12, the following steps reflect the generation of the time example of 10:29 shown in FIG. 2 (*c*). To display the initial "1" as the hour×10 digit, the microcontroller 16 proceeds from Block 50 into the subroutine, and through Blocks 90 and 92 to direct a flashing of light elements **12*a*–12*e* from top to bottom a single time, as required by Block 96. The subsequent "0" as the hour×1 digit is then generated following a digit delay at Block 54 by the microcontroller proceeding from Block 56 into the subroutine and through Block 90 to direct a flashing of light elements 12*a* and 12*e* at the top and bottom once, as required in Block 98. After another digit delay at Block 60, the "2" as the minute×10 digit is generated by the microcontroller 16 proceeding within the subroutine through Blocks 90 and 92 to direct a flashing of the light elements 12*a*–12*e* twice from top to bottom, as directed by Block 96. The final "9" as the minute×1 digit is then generated after a delay at Block 66 by the microcontroller 16 proceeding from Block 68 into the subroutine and through Blocks 90, 92 and 94 to determine a flashing of light elements through Blocks 90, 92 and 94 to determine a flashing of light elements 12*a*–12*e* four times from bottom to top, as directed by Block 95**.

Upon a complete display of time, the present electro-optical signaling system 10 may then proceed with a display of the ambient temperature. As shown in the main routine of FIG. 3, the display of the temperature begins in Block 72 with the setting of the internal microcontroller timer for a period of fifteen seconds similar to that of the time display cycle. Also like that of the time display cycle, the decrement timer, then proceeds to subtract one second from the present timer's contents of time in Block 74. If the seconds equal "0", it is appropriate to start the temperature display and all light elements **12*a*–12*e* of light array 12 flashed a predetermined number of times, for example two, to provide a signal to the observer that the temperature display is forthcoming. If the seconds are not equal to "0", then operation of microcontroller 16 returns to Block 74** to decrement further time.

To initiate the actual temperature display, microcontroller 16 proceeds by obtaining the number of the temperature×10 digit from the A/D converter 30 and going to the subroutine of Block 90–98 for appropriate signaling to the light array 12 depending upon the value of the temperature×10 digit. Thus depending upon the value of that digit, a directional flashing of the initial digit of temperature is displayed upon light array 12. After an appropriate digit delay, similar to that undergone in the time display cycle, the number of the temperature×1 digit or second digit of temperature is obtained from the A/D converter 30 and processed through the subroutine of Blocks 90–98 to have microcontroller 16 generate the appropriate signals to light array 12 as an indication of that second temperature digit. A complete temperature display is thus provided by the electro-optical signaling system 10 consisting of two distinct flashing patterns of the light elements 12*a*–12*e* of array 12.

Therefore, it is apparent that the disclosed electro-optical signaling system 10 provides an improved display system and associated method of employing flashing lights to communicate a numerical message to an observer in all radial directions surrounding the flashing lights. In addition, the disclosed invention and its system of flashing lights may easily be viewed and readily understood by observers from a variety of angles and attitudes, communicating useful numerical information such as that relative to time of day and ambient temperature. Furthermore, the present invention provides a signaling system that is simple to construct yet reliable in performance and that is easily adapted for stationing in various display environments.

Obviously, other embodiments and modifications of the present invention will readily come to those of ordinary skill in the art having the benefit of the teachings presented in the foregoing description and drawings. It is therefore to be understood that various changes in the details, materials, steps, and arrangements of parts, which have been described and illustrated to explain the nature of the invention, may be made by those skilled in the art within the principle and scope of the invention as expressed in the appended claims.

What is claimed is:

1. An electro-optical signaling system for displaying measured numerical information in a flashing light pattern known to an observer, comprising:

a linear array of light elements;

means for generating data indicative of successive digits of the measured numerical information; and microcontroller means adapted to process said data and provide said linear array with energization signals based thereon for flashing the light elements in said pattern with all of the light elements being flashed simultaneously a repeated number of times to begin the display of numerical information and with a sufficient time delay provided to distinguish successive digits as follows: ones of the light elements at each end of said array being flashed simultaneously when a respective digit is a zero; all of the light elements being flashed sequentially in one direction a predetermined number of times when a respective digit is from one to five with said predetermined number in the one direction being equal to the value of the respective digit; and all of the light elements being flashed sequentially in an opposite direction a predetermined number of times when a respective digit is from six to nine with said predetermined number in the opposite direction being equal to the value of the respective digit reduced by five.

2. A method of displaying successive digits of measured numerical information in a coded light pattern known to an observer using a linear array of light elements, comprising the steps of:

simultaneously flashing all light elements a repeated number of times to begin the display of numerical information;

simultaneously flashing those light elements at each end of said linear array when a respective digit of numerical information is a zero;

sequentially flashing in one direction all light elements of said linear array a predetermined number of times when a respective digit of numerical information is from one to five, said predetermined number being equal to the value of the respective digit;

sequentially flashing in an opposite direction all light elements of said linear array of predetermined number of times when a respective digit of numerical information is from six to nine, said predetermined number being equal to the value of the respective digit reduced by five; and causing a sufficient time delay between any of said steps of flashing to allow the observer to distinguish successive digits of the numerical information.

3. A method according to claim 2, wherein prior to each of said steps of flashing light elements, the method further comprises:

generating data indicative of successive digits of measured numerical information; and processing said data under direction of a control algorithm to automatically generate energization signals for flashing light elements of said linear array.

4. A method according to claim 2, wherein said linear array is in a vertical direction and:

said step of simultaneously flashing is of top and bottom light elements of said array;

said step of sequentially flashing all light elements is in a downward direction when the respective digit is from one to five; and said step of sequentially flashing all light elements is in a upward direction when the respective digit is from six to nine.

5. A method according to claim 3, wherein said data generated and processed is indicative of time of day.

6. A method according to claim 3, wherein said data generated and processed is indicative of ambient temperature.

* * * * *